US005140761A

United States Patent [19]

Coffman et al.

[11] Patent Number: 5,140,761

[45] Date of Patent: Aug. 25, 1992

[54] DRAGLINE BUCKET LINE PROTECTION DEVICE

[75] Inventors: Ralph E. Coffman, Bucyrus; Joseph B. Kumpf, Marion, both of Ohio

[73] Assignee: Dresser Industries, Inc., Dallas, Tex.

[21] Appl. No.: 813,356

[22] Filed: Dec. 24, 1991

[51] Int. Cl.[5] ..... E02F 3/48; E02F 3/58

[52] U.S. Cl. ..... 37/115; 37/135; 59/93; 24/129 A

[58] Field of Search ..... 37/115, 116, 117, 135; 59/85, 93, 900; 24/129 A

[56] References Cited

U.S. PATENT DOCUMENTS

| | | | |
|---|---|---|---|
| 852,863 | 5/1907 | Wiles | 37/135 |
| 1,053,783 | 2/1913 | Butler . | |
| 1,833,587 | 11/1931 | Page . | |
| 1,836,867 | 12/1931 | Page . | |
| 1,850,767 | 3/1932 | Page . | |
| 1,879,448 | 9/1932 | Page | 37/135 |
| 2,092,556 | 9/1937 | Page | 37/135 |
| 2,261,233 | 11/1941 | Dausman | 37/135 |
| 2,286,765 | 6/1942 | Settersten | 37/135 |
| 2,588,657 | 3/1952 | Pitts | 37/135 |
| 2,831,274 | 4/1958 | Addicks | 37/135 |
| 3,352,038 | 11/1967 | Kalve | 37/135 |
| 4,689,904 | 9/1987 | Briscoe | 37/135 |
| 4,731,941 | 3/1988 | Beatty | 37/115 |
| 4,864,747 | 9/1989 | Martin et al. | 37/115 |

*Primary Examiner*—Randolph A. Reese
*Assistant Examiner*—Arlen L. Olsen
*Attorney, Agent, or Firm*—Ross, Howison, Clapp & Korn

[57] ABSTRACT

In a support assembly for an excavating dragline bucket controlled by a hoist line and a drag line, the bucket having opposite side walls and an open forward end, a line protection device includes a sleeve for encircling the hoist line adjacent the bucket sidewalls for preventing direct contact between the hoist line and the bucket sidewalls. A sleeve also encircles the drag line adjacent the point of attachment between the drag line and the bucket forward end for preventing direct contact between the drag line and excavating material received by the bucket.

12 Claims, 2 Drawing Sheets

DRAGLINE BUCKET LINE PROTECTION DEVICE

TECHNICAL FIELD OF THE INVENTION

This invention relates to dragline buckets, and more particularly to a bucket rigging device for protecting hoist lines and drag lines.

BACKGROUND OF THE INVENTION

Dragline buckets are used to excavate, dig, scrape, or drag earth, for example, in strip mining operations. In such operations, buckets are suspended from cranes or the like by a hoist line, and are manipulated by the hoist line and other control lines so as to dig earth from one location and then move the earth filled bucket to another location where it is dumped. Because of the size and cost of the machinery involved, it is desirable to obtain maximum use of the machinery in order to achieve maximum cost efficiency.

In dragline machinery where wire lines are utilized for the hoist and drag lines, these lines interact with the dragline bucket and the earth being excavated, thereby incurring damage and wear. Replacement of such lines can be time consuming, and thus replacement of these lines can hinder the cost effective use of the machinery.

A need has thus arisen for a wire line protection device for minimizing abrasive wear, accidental damage and nonrepairability of such lines which are directly connected to a dragline bucket.

SUMMARY OF THE INVENTION

In accordance with the present invention, in a support assembly for an excavating dragline bucket controlled by a hoist line and a drag line, the bucket having opposite side walls and an open forward end, a line protection device is provided. The line protection device includes a sleeve for encircling the hoist line adjacent the bucket sidewalls for preventing direct contact between the hoist line and the bucket sidewalls. A sleeve is also provided for encircling the drag line adjacent the point of attachment between the drag line and the bucket forward end for preventing direct contact between the dragline and excavating material received by the bucket.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
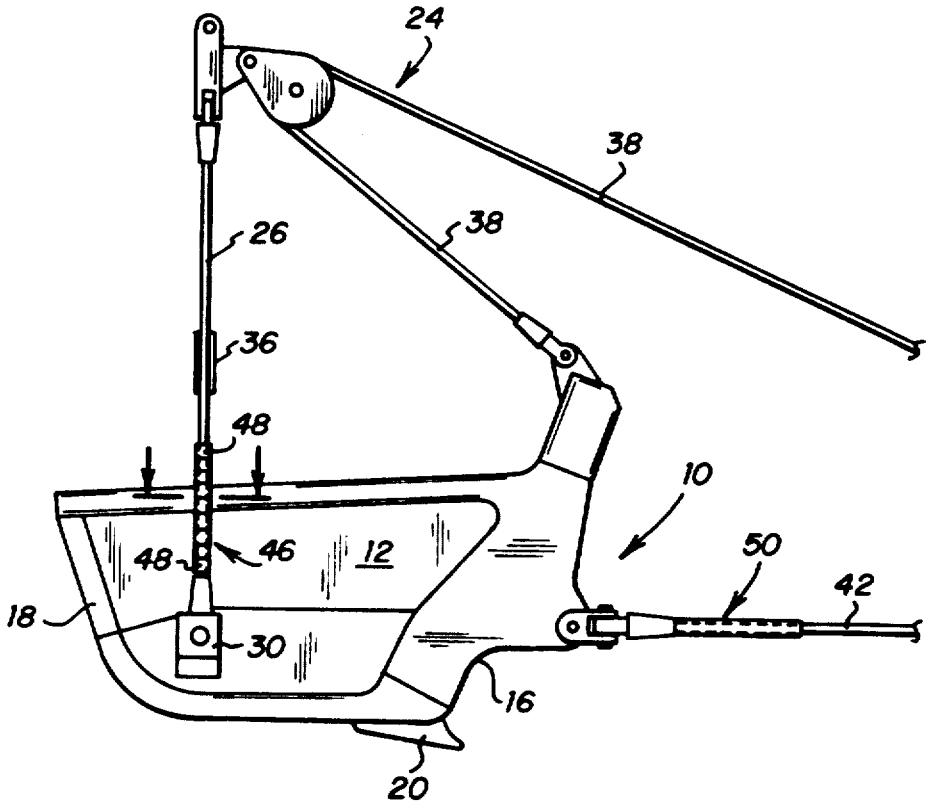
FIG. 1 is a side elevational view of a dragline bucket and rigging showing the protection device of the present invention.
Figure 2:
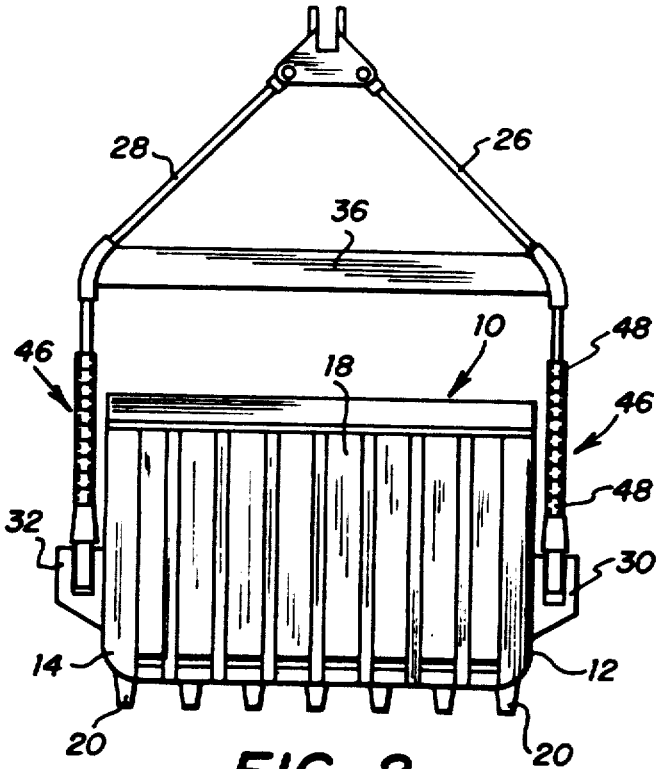
FIG. 2 is an end view of the bucket shown in FIG. 1.
Figure 3:
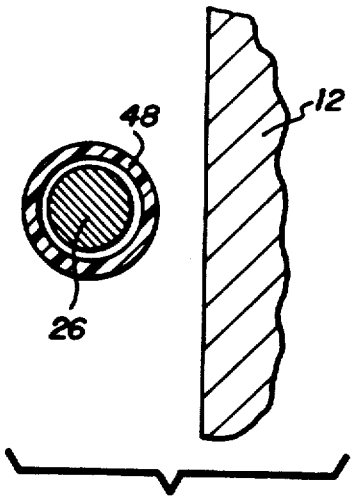
FIG. 3 is a sectional view taken generally along sectional lines 3—3 of FIG. 1.

Referring simultaneously to FIGS. 1, 2, and 3, a dragline bucket is illustrated, and is generally identified by the numeral 10. Dragline bucket 10 includes sidewalls 12 and 14, an open forward end 16, and a rear wall 18. Disposed adjacent open forward end 16 are a plurality of teeth 20.

Interconnected to dragline bucket 10 is a bucket rigging structure, generally identified by the numeral 24. Rigging structure 24 includes hoist lines or links 26 and 28 which are interconnected to side walls 12 and 14, respectively, through trunnion links 30 and 32, respectively. A spreader bar 36 is interconnected between hoist lines 26 and 28.

Rigging structure 24 further includes a control line 38 which is interconnected to a common connection with the drag lines for dragline bucket manipulation. Further interconnected to dragline bucket 10 are drag lines 42 which control movement of dragline bucket 10 through the earth being excavated. One or more drag lines 42 are connected generally to each side of the bucket 10 sidewalls 12 and 14.

An important aspect of the present invention is the use of a sleeve assembly, generally identified by the numeral 46. Sleeve 46 provides insulation to hoist lines 26 and 28 to prevent hoist lines 26 and 28 from incurring abrasion or damage by contact with dragline bucket sidewalls 12 and 14. Sleeve 46 may be a continuous structure as illustrated in FIG. 2 associated with hoist line 28 or may be composed of a plurality of segments or rings 48 as illustrated in FIGS. 1 and 2 associated with hoist line 26. Sleeve 46 may be comprised of, for example, nylon material.

Disposed on each of drag lines 42 is a sleeve, generally identified by the numeral 50. Sleeve 50 protects drag lines 42 from abrasion and damage due to contact with earth being loaded into dragline bucket 10 through open forward end 16. Sleeve 50 may be comprised of, for example, nylon, and may also be segmented as sleeve 46.

Figure 4:
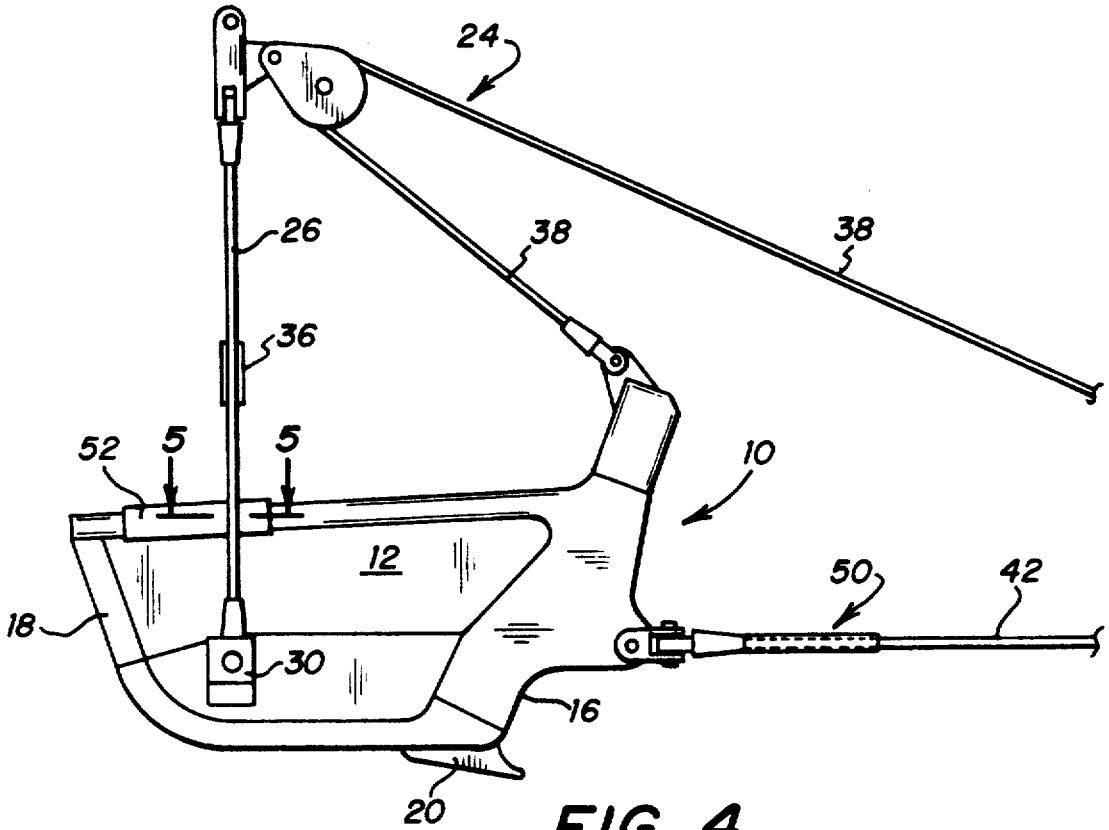
FIG. 4 is a side elevational view of a dragline bucket and rigging showing an additional embodiment of the present protection device.
Figure 5:
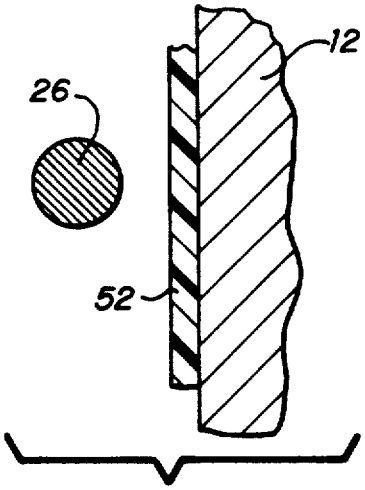
FIG. 5 is a sectional view taken generally along sectional lines 5—5 of FIG. 4.

Referring now simultaneously to FIGS. 4 and 5, wherein like numerals are utilized for like and corresponding elements previously identified, a further embodiment of the present invention is illustrated. Disposed on sidewalls 12 and 14 of bucket 10, is a protective strip 52 for providing insulation to hoist lines 26 and 28 by preventing contact with dragline bucket sidewalls 12 and 14, respectively. Protective strip 52 prevents abrasive wear and damage to hoist lines 26 and 28 by preventing contact with dragline bucket 10.

It therefore can be seen that the present invention provides for hoist and dragline protection devices to prevent wear and damage to these lines in the area of attachment to a dragline bucket. The present invention increases the life of rigging lines thereby minimizing the cost of operation of a dragline unit.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. In a support assembly for an excavating dragline bucket controlled by a hoist line and a drag line, the bucket having opposite sidewalls and an open forward end, a line protection device comprising:

sleeve means for encircling the hoist line adjacent the bucket sidewalls for preventing direct contact between the hoist line and the bucket sidewalls, said sleeve means being slidable along the hoist line and rotatable around the hoist line without direct connection to the hoist line.

2. The line protection device of claim 1 wherein said sleeve means includes a plurality of circular rings.

3. The line protection device of claim 1 wherein said sleeve means includes nylon material.

4. The line protection device of claim 1 and further including:

sleeve means for encircling the drag line adjacent the point of attachment between the drag line and the bucket forward end for preventing direct contact between the drag line and excavating material received by the dragline bucket in the area of the open forward end thereof, said sleeve means being slidable along the drag line and rotatable around the drag line without direct connection to the drag line.

5. In a support assembly for an excavating dragline bucket controlled by a hoist line and a drag line, the bucket having opposite sidewalls and an open forward end, a line protection device comprising:

sleeve means for encircling the drag line adjacent the point of attachment between the drag line and the bucket forward end for preventing direct contact between the drag line and excavating material received by the dragline bucket in the area of the open forward end thereof, said sleeve means being slidable along the drag line and rotatable around the drag line without direct connection to the drag line.

6. The line protection device of claim 5 wherein said sleeve means includes a plurality of circular rings.

7. The line protection device of claim 5 wherein said sleeve means includes nylon material.

8. In a support assembly for an excavating dragline bucket controlled by a hoist line and a drag line, the bucket having opposite sidewalls, each sidewall having a top and bottom, and an open forward end, a line protection device comprising:

an elongated strip mounted on the bucket sidewalls adjacent said sidewall top for preventing direct contact between the hoist line and the bucket sidewalls.

9. The line protection device of claim 8 wherein said means includes nylon material.

10. The line protection device of claim 8 and further including:

sleeve means for encircling the drag line adjacent the point of attachment between the drag line and the bucket forward end for preventing direct contact between the dragline and excavating material received by the dragline bucket in the area of the open forward end thereof, said sleeve means being slidable along the drag line and rotatable around the drag line without direct connection to the drag line.

11. The line protection device of claim 10 wherein said sleeve means includes a plurality of circular rings.

12. The line protection device of claim 10 wherein said sleeve means includes nylon material.

* * * * *